US010695898B2

(12) United States Patent
Liu et al.

(10) Patent No.: US 10,695,898 B2
(45) Date of Patent: Jun. 30, 2020

(54) ADJUSTABLE DEPTH-OF-DRIVE NAIL GUN

(71) Applicant: BASSO INDUSTRY CORP., Taichung (TW)

(72) Inventors: An-Gi Liu, Taichung (TW); Yuan-Chi Chiang, Taichung (TW); Fu-Ying Huang, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 168 days.

(21) Appl. No.: 15/977,234

(22) Filed: May 11, 2018

(65) Prior Publication Data

US 2018/0326567 A1 Nov. 15, 2018

(30) Foreign Application Priority Data

May 15, 2017 (TW) ..... 106115952 A

(51) Int. Cl.
*B25C 1/04* (2006.01)
*B25C 1/00* (2006.01)
*B25C 1/08* (2006.01)

(52) U.S. Cl.
CPC ..... *B25C 1/008* (2013.01); *B25C 1/04* (2013.01); *B25C 1/047* (2013.01); *B25C 1/08* (2013.01)

(58) Field of Classification Search
CPC .. B25C 1/04; B25C 1/08; B25C 1/008; B25C 1/06; B25C 1/188; B25C 1/047
USPC ..... 227/8, 142, 120, 130, 109
See application file for complete search history.

(56) References Cited

U.S. PATENT DOCUMENTS 5,839,638 A * 11/1998 Ronn ..... B25C 1/008 227/8
6,186,386 B1 * 2/2001 Canlas ..... B25C 1/008 227/142
6,705,501 B2 * 3/2004 Miller ..... B25C 1/008 227/142
6,783,044 B2 * 8/2004 Perra ..... B25C 1/008 227/8
6,866,177 B1 * 3/2005 Chen ..... B25C 1/008 227/142
6,959,850 B2 * 11/2005 Taylor ..... B25C 1/008 227/107
6,988,648 B2 1/2006 Taylor et al.
7,055,729 B2 * 6/2006 Taylor ..... B25C 1/008 227/142

(Continued)

OTHER PUBLICATIONS

The Search Report issued to European counterpart application No. 18172043.4 by the EPO dated Oct. 19, 2018.

(Continued)

*Primary Examiner* — Scott A Smith
(74) *Attorney, Agent, or Firm* — Burris Law, PLLC

(57) ABSTRACT

A nail gun includes a gun body, a safety unit and an adjusting unit. The safety unit includes a first safety member movable relative to the gun body, and a second safety member for being pushed by the first safety member. The adjusting unit includes a switch member movable between a deep-drive position and a shallow-drive position. The switch member has a first abutment surface aligned with the first safety member when the switch member is at the deep-drive position, and a second abutment surface aligned with the first safety member when the switch member is at the shallow-drive position.

9 Claims, 11 Drawing Sheets

(56) References Cited

U.S. PATENT DOCUMENTS

| | | | | |
|---|---|---|---|---|
| 7,753,243 | B2 * | 7/2010 | Brendel | B25C 1/06 227/119 |
| 8,523,038 | B2 * | 9/2013 | Liao | B25C 1/188 227/142 |
| 2005/0218176 | A1 | 10/2005 | Schell et al. | |

OTHER PUBLICATIONS

The Examination Report issued to Australian counterpart application No. 2018203344 by the IP Australia dated Feb. 26, 2019.

* cited by examiner

ADJUSTABLE DEPTH-OF-DRIVE NAIL GUN

CROSS-REFERENCE TO RELATED APPLICATION

This application claims priority of Taiwanese Invention Patent Application No. 106115952, filed on May 15, 2017.

FIELD

The disclosure relates to a nail gun, and more particularly to an adjustable depth-of-drive nail gun.

BACKGROUND

Referring to FIG. 1, a conventional nail gun 1 includes a gun body 11, a muzzle 12 formed at a front portion of the gun body 11, a first safety member 13 movably mounted to the muzzle 12, a second safety member 14 movably mounted to the gun body 11, and an adjusting assembly 15 interconnecting the first and second safety members 13, 14 and located at a lower portion of the gun body 11. The adjusting assembly 15 includes a rotary member 151. Rotation of the rotary member 151 drives movement of the first safety member 13 relative to the second safety member 14 in a nail-firing direction (Z) so as to adjust an extent by which the first safety member 13 projects out of the muzzle 12. By such, the conventional nail gun 1 is capable of driving nails (not shown) into an object by different depths.

However, since the adjusting assembly 15 is located at the lower portion of the gun body 11 and since the rotary member 151 is operated in a manner of being rotated, operation of the rotary member 151 is inconvenient, and is easily hindered by the gun body 11.

Another conventional nail gun disclosed in U.S. Pat. No. 6,988,648 includes first and second safety members, a thumb post that co-movably mounted to the first safety member, and a thumb wheel rotatable to drive movement of the thumb post so as to drive movement of the first and second safety members relative to each other for adjusting the depth-of-drive. However, operation of the thumb wheel is similar to the rotary member 151 in FIG. 1, and is inconvenient.

SUMMARY

Therefore, an object of the disclosure is to provide a nail gun that can alleviate at least one of the drawbacks of the prior arts.

According to the disclosure, the nail gun includes a gun body, a safety unit and an adjusting unit. The gun body includes a muzzle, and an operation portion that is for activating firing operation. The safety unit includes a first safety member that is movable relative to the muzzle in a lengthwise direction of the gun body, and a second safety member that is for being pushed by the first safety member to actuate the operation portion and that is movable relative to the gun body between an initial position and an actuating position. The first safety member has an abutment portion. The second safety member is distal from a rear portion of the gun body when being at the initial position. The second safety member is proximate to the rear portion of the gun body and actuates the operating portion when being at the actuating position. The adjusting unit includes a fixing member that is co-movably mounted to the second safety member, and a switch member that is disposed between the fixing member and the second safety member and that is movable relative to the second safety member in a lateral direction of the gun body between a deep-drive position and a shallow-drive position. The switch member is configured for being pushed by the first safety member so as to move the second safety member, and has a first abutment surface, and a second abutment surface that is misaligned from the first abutment surface in the lengthwise direction and that is located ahead of the first abutment surface by a length difference. The first abutment surface is aligned with the abutment portion of the first safety member when the switch member is at the deep-drive position. The second abutment surface is aligned with the abutment portion of the first safety member when the switch member is at the shallow-drive position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
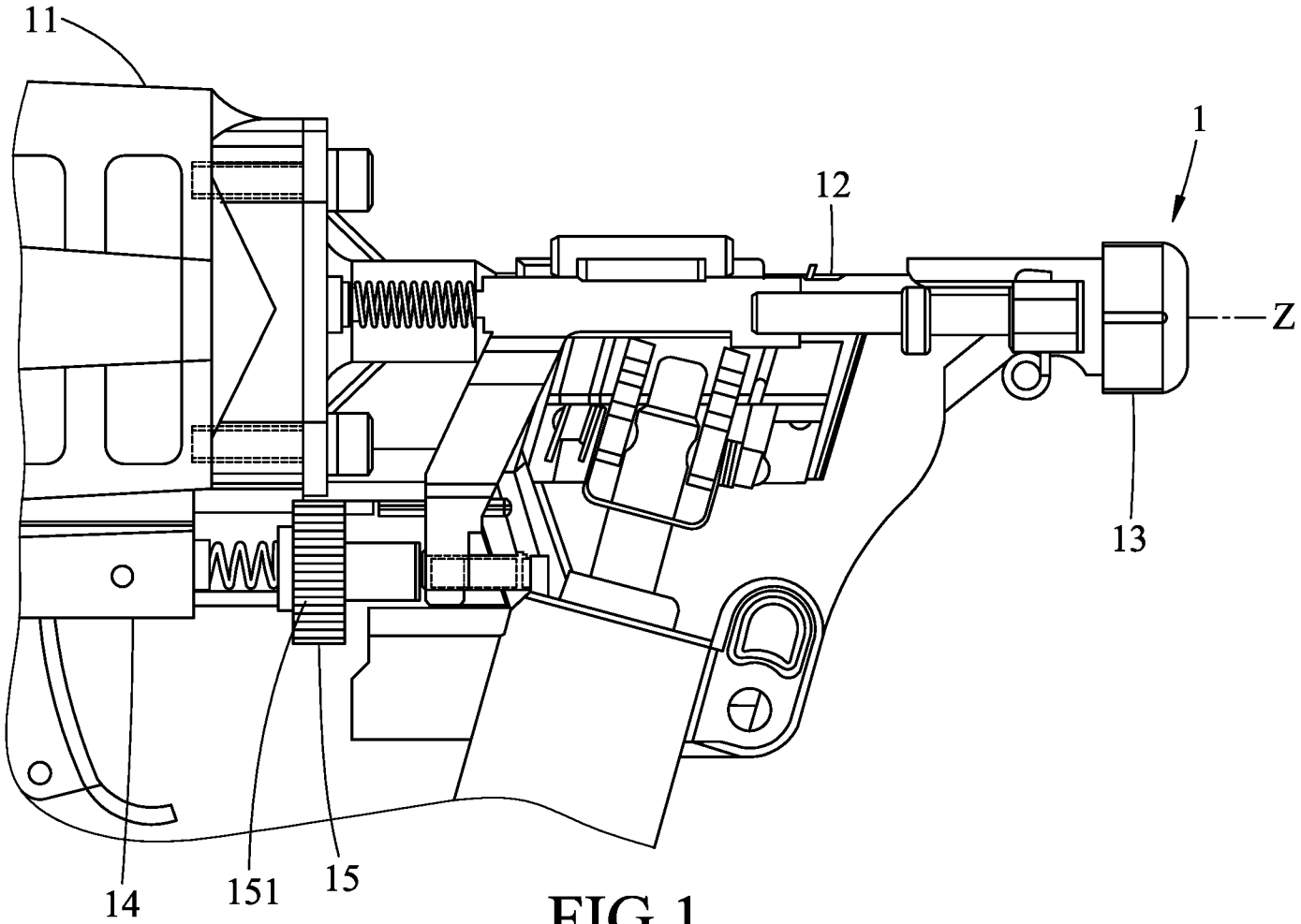
FIG.1 PRIOR ART
FIG. 1 is a fragmentary side view illustrating a conventional nail gun.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
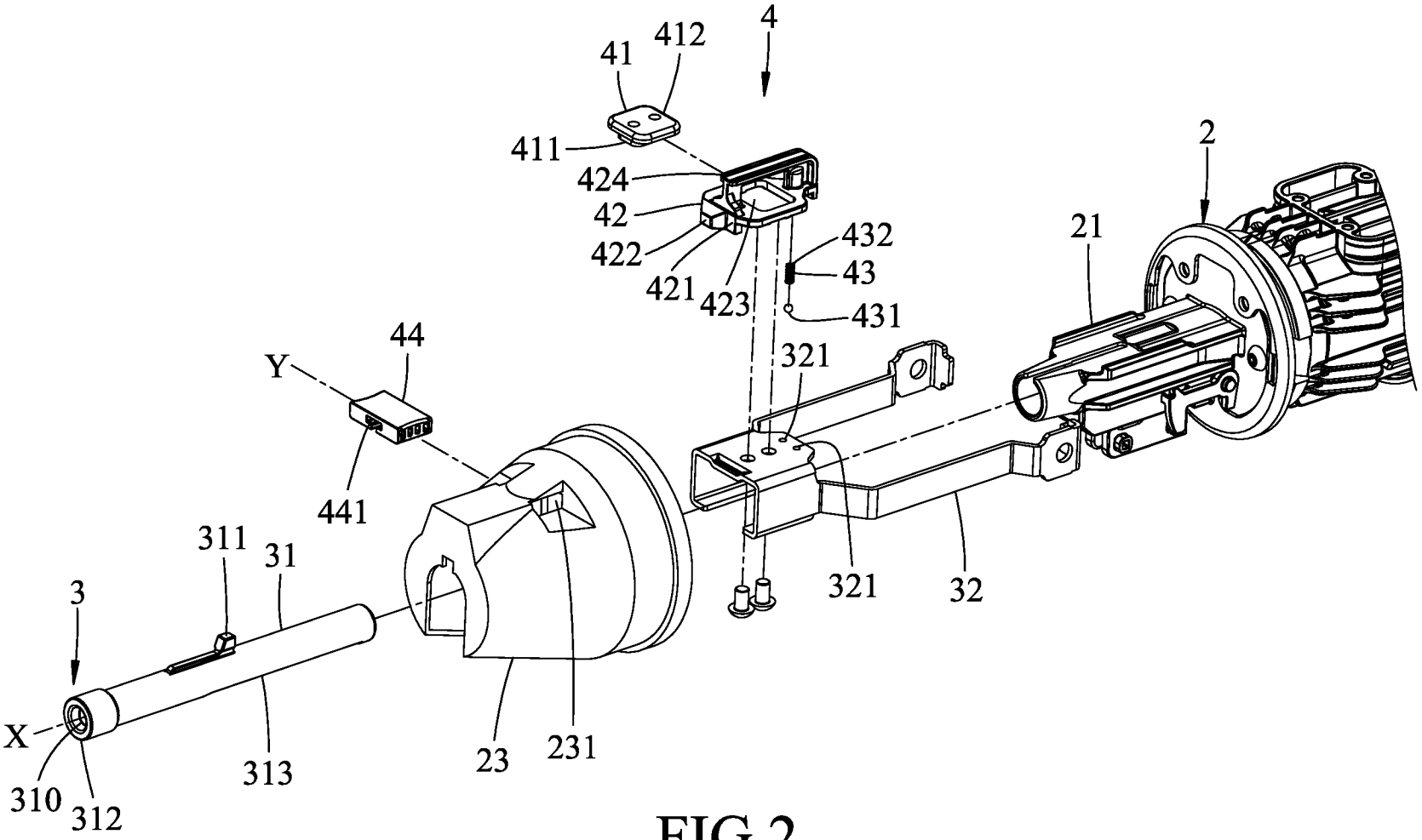
FIG. 2 is a fragmentary exploded perspective view illustrating an embodiment of the nail gun according to the disclosure.
Figure 3:
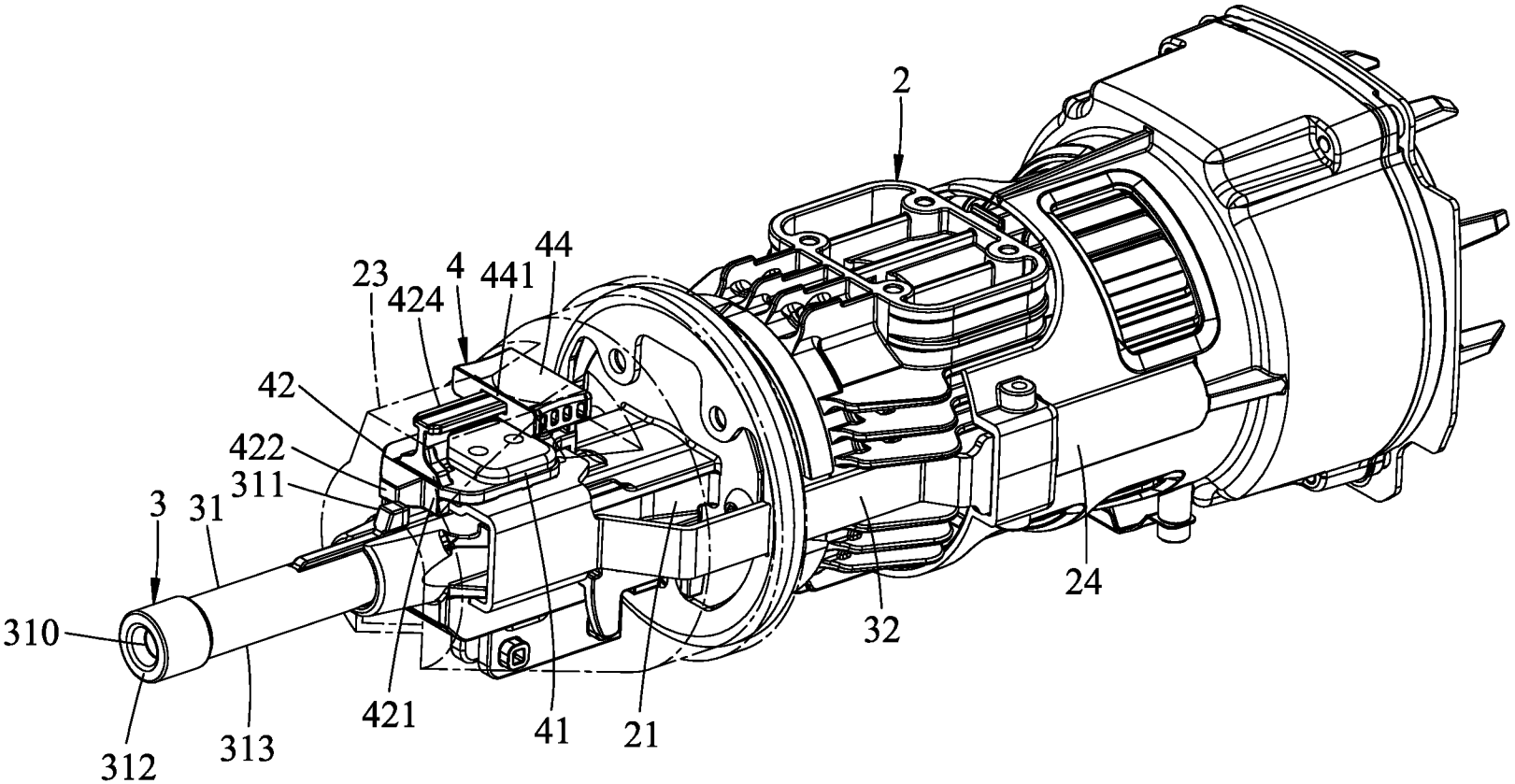
FIG. 3 is an assembled perspective view illustrating the embodiment.
Figure 4:
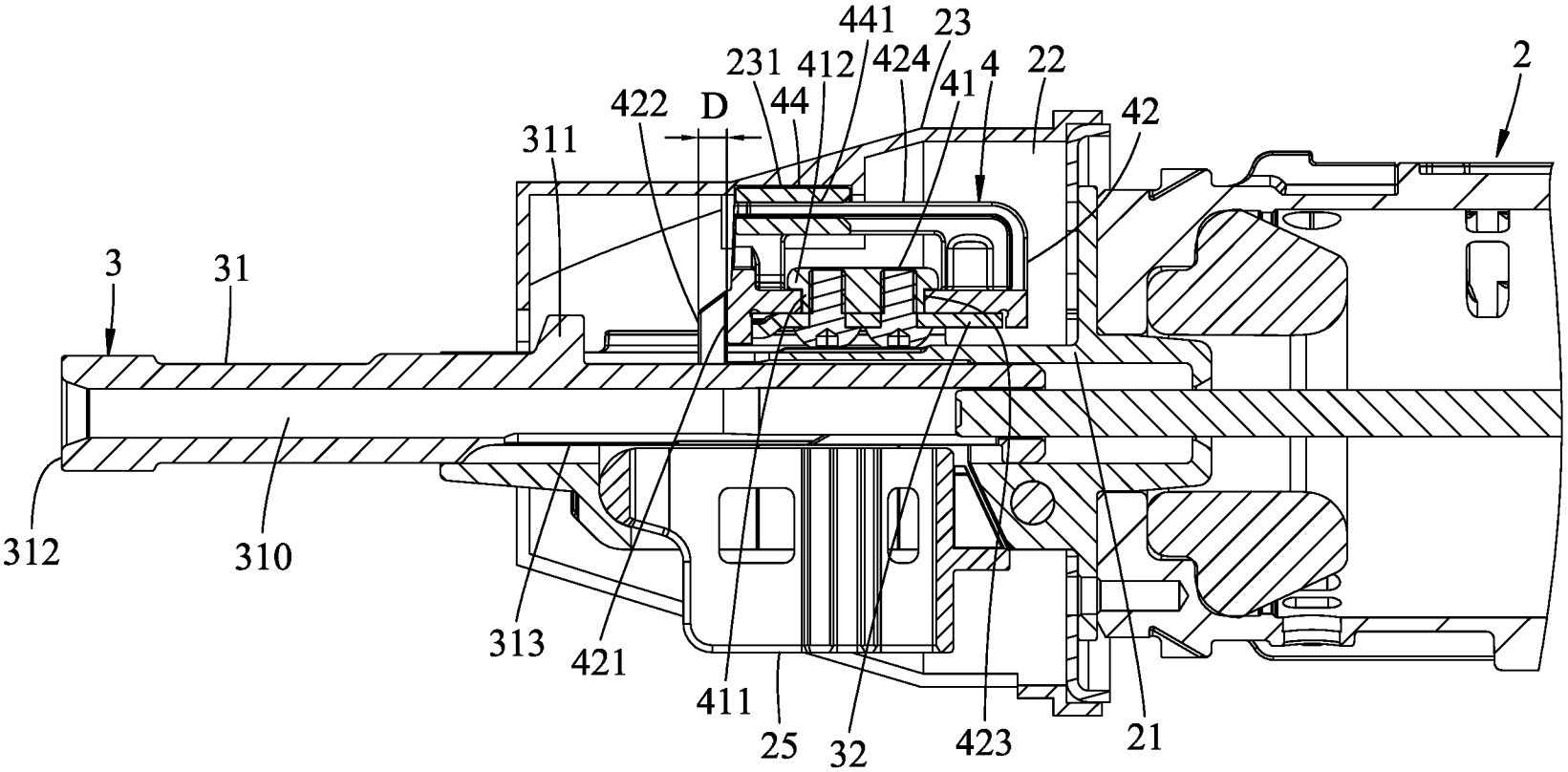
FIG. 4 is a fragmentary sectional view illustrating the embodiment.

Referring to FIGS. 2 to 4, the embodiment of the nail gun according to the disclosure includes a gun body 2, a safety unit 3 and an adjusting unit 4.

The gun body 2 includes a muzzle 21 that is located to a front end of the gun body 2, a cap member 23 that is mounted on the muzzle 21 and that cooperates with the muzzle 21 to define a retaining space 22 therebetween, an operation portion 24 that is for activating firing operation, and a delivering member 25 that is connected to the muzzle 21 for delivering nails (not shown) into the muzzle 21. The cap member 23 is formed with a mounting groove 231 that extends in a lateral direction (Y) of the gun body 2. In one embodiment, the nail gun may be configured as a combustion-powered nail gun, and the operation portion 24 may be configured as a valve sleeve for sealing a combustion chamber (not shown). In one embodiment, the nail gun may be configured as a pneumatic nail gun, and the operation portion 24 may be configured as an actuating plate of a trigger assembly. The configuration of the operation portion 24 is well-known in the art, and would not be further described in the following paragraphs.

Figure 7:
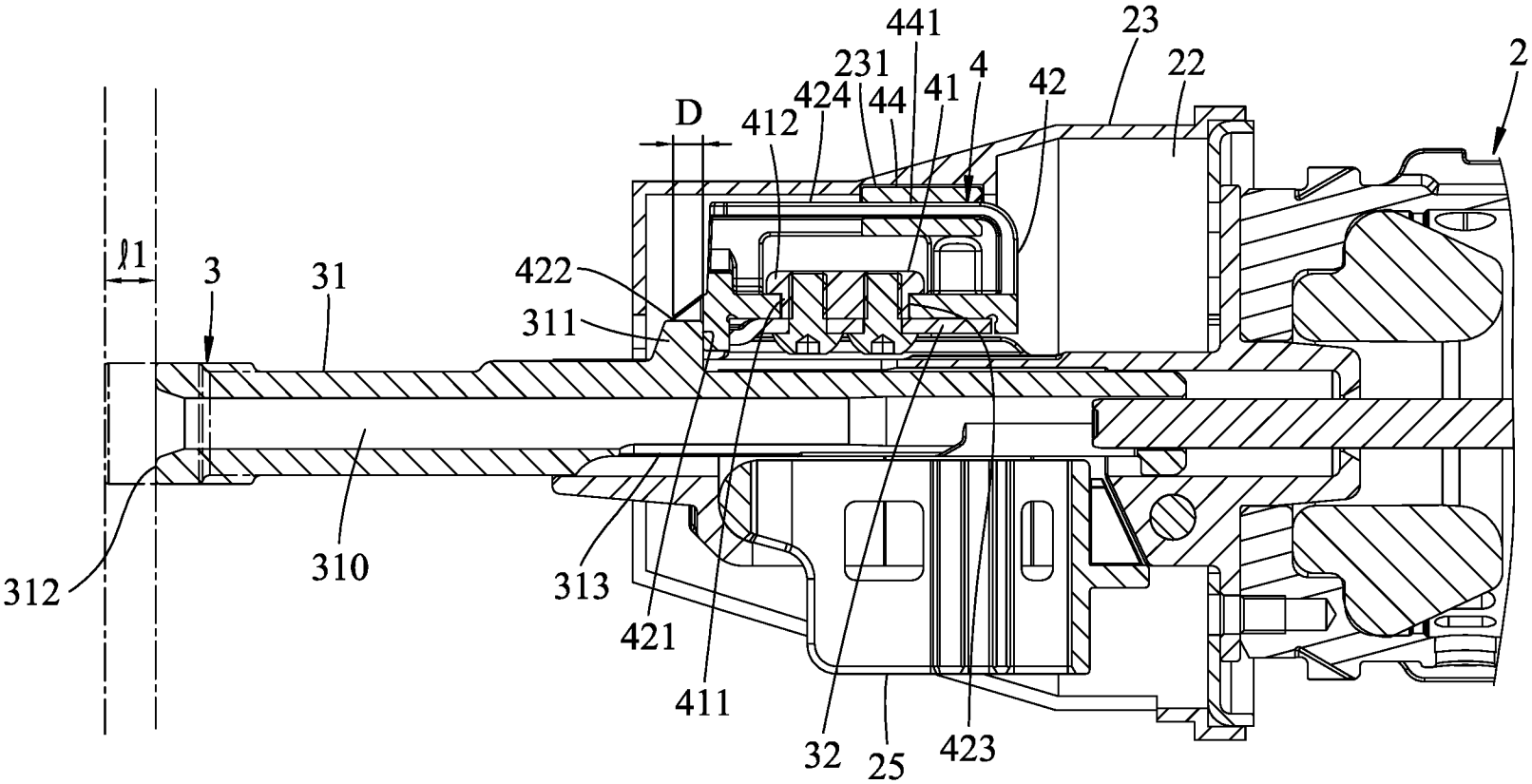
FIG. 7 is a sectional view taken along line VII-VII in FIG. 5 and illustrating a second safety member at an initial position.
Figure 8:
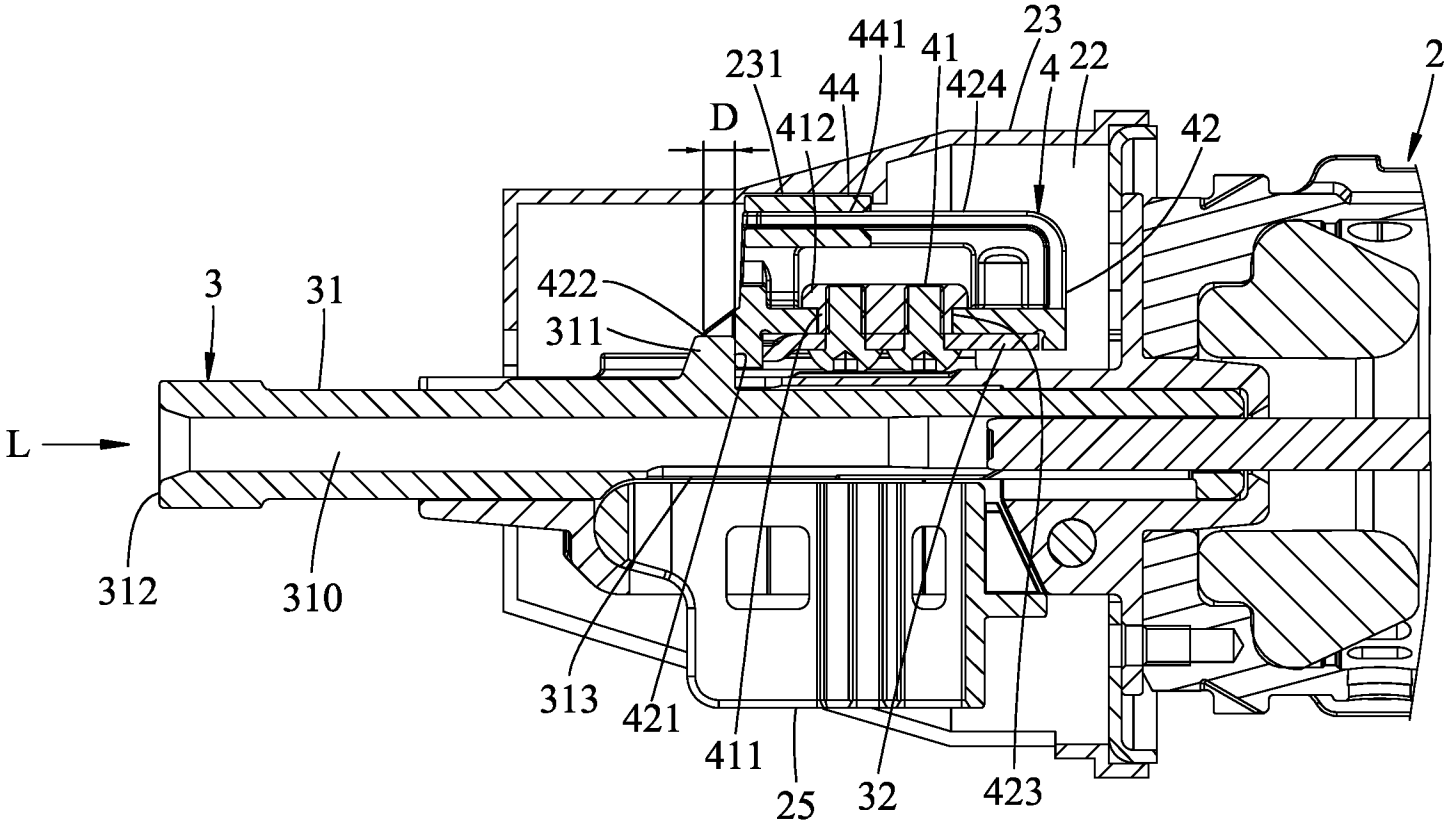
FIG. 8 is a sectional view similar to FIG. 7 and illustrating the second safety member at an actuating position.

The safety unit 3 includes a first safety member 31 that is movable relative to the muzzle 21 in a lengthwise direction (X) of the gun body 2, and a second safety member 32 that is for being pushed by the first safety member 31 to actuate the operation portion 24 and that is movable relative to the gun body 2 between an initial position (see FIG. 7) and an actuating position (see FIG. 8). In one embodiment, the first safety member 31 is inserted into that muzzle 21, and has a nail path 310 that extends in the lengthwise direction (X), an abutment portion 311 that is formed on an outer surface thereof, a pressing end 312 that is disposed out of the muzzle 21, and a delivering opening 313 that is in communication with the nail path 310 and the delivering member 25. The first safety member 31 has an opening-defining surface that defines the delivering opening 313. A rear surface portion of the opening-defining surface that faces forwardly is aligned with the delivering member 25 in the lengthwise direction (X), so that forward movement of the first safety member 31 relative to the cap member 23 is limited by the delivering member 25. The second safety member 32 has two positioning structures 321 that are disposed in the lateral direction (Y). In one embodiment, each of the positioning structures 321 is configured as a recess. The second safety member 32 is distal from a rear portion of the gun body 2 when being at the initial position (see FIG. 7), and is proximate to the rear portion of the gun body 2 and actuate the operating portion 24 when being at the actuating position (see FIG. 8). In the case that the nail gun is configured as a combustion-powered nail gun, the operation portion 24 may be configured as a valve sleeve that is co-movable with the second safety member 32 for sealing the combustion chamber.

The adjusting unit 4 is partially received in the retaining space 22, and includes a fixing member 41 that is co-movably mounted to the second safety member 32, a switch member 42 that is disposed between the fixing member 41 and the second safety member 32 and that is movable relative to the second safety member 32 in the lateral direction (Y) between a deep-drive position (see FIG. 5) and a shallow-drive position (see FIG. 9), a positioning assembly 43, and an operating member 44.

The fixing member 41 has a guide portion 411 that is fixedly connected to the second safety member 32, and a limiting portion 412 that is fixedly connected to the guide portion 411 and that is spaced apart from the second safety member 32.

The switch member 42 is in slidable contact with the second safety member 32, and has a first abutment surface 421 that is for being pushed by the abutment portion 311 of the first safety member 31, a second abutment surface 422 that is for being pushed by the abutment portion 311 of the first safety member 31, that is misaligned from the first abutment surface 421 in the lengthwise direction (X), and that is located ahead of the first abutment surface 421 by a length difference (D), a guide opening 423, and a guide rail 424 that is located above the guide opening 423. The limiting portion 412 of the fixing member 41 is in slidable contact with the switch member 42 so as to confine the switch member 42. The guide opening 423 of the switch member 42 is slidably engaged with the guide portion 411 of the fixing member 41, so that the switch member 42 is movable relative to the second safety member 32 in the lateral direction (Y) between the deep-drive position and the shallow-drive position, and is co-movable with the second safety member 32 in the lengthwise direction (X).

When the switch member 42 is at the deep-drive position, the first abutment surface 421 is aligned with the abutment portion 311 of the first safety member 31 in the lengthwise direction (X). When the switch member 42 is at the shallow-drive position, the second abutment surface 422 is aligned with the abutment portion 311 of the first safety member 31 in the lengthwise direction (X).

The positioning assembly 43 includes a latch member 431 that is movable relative to the switch member 42 and that is operable to removably engage either one of the positioning structures 321 of the second safety member 32, and a resilient member 432 that interconnects the latch member 431 and that switch member 42. In one embodiment, the latch member 431 is configured as a spherical body. The resilient member 432 resiliently biases the latch member 431 to engage a selective one of the positioning structures 321.

The operating member 44 is movably mounted to the mounting groove 231 of the cap member 23, and is formed with a guide groove 441 that extends in the lengthwise direction (X). The guide groove 441 is slidably engaged with the guide rail 424 of the switch member 42, so that the switch member 42 is movable relative to the operating member 44 in the lengthwise direction (X).

Figure 5:
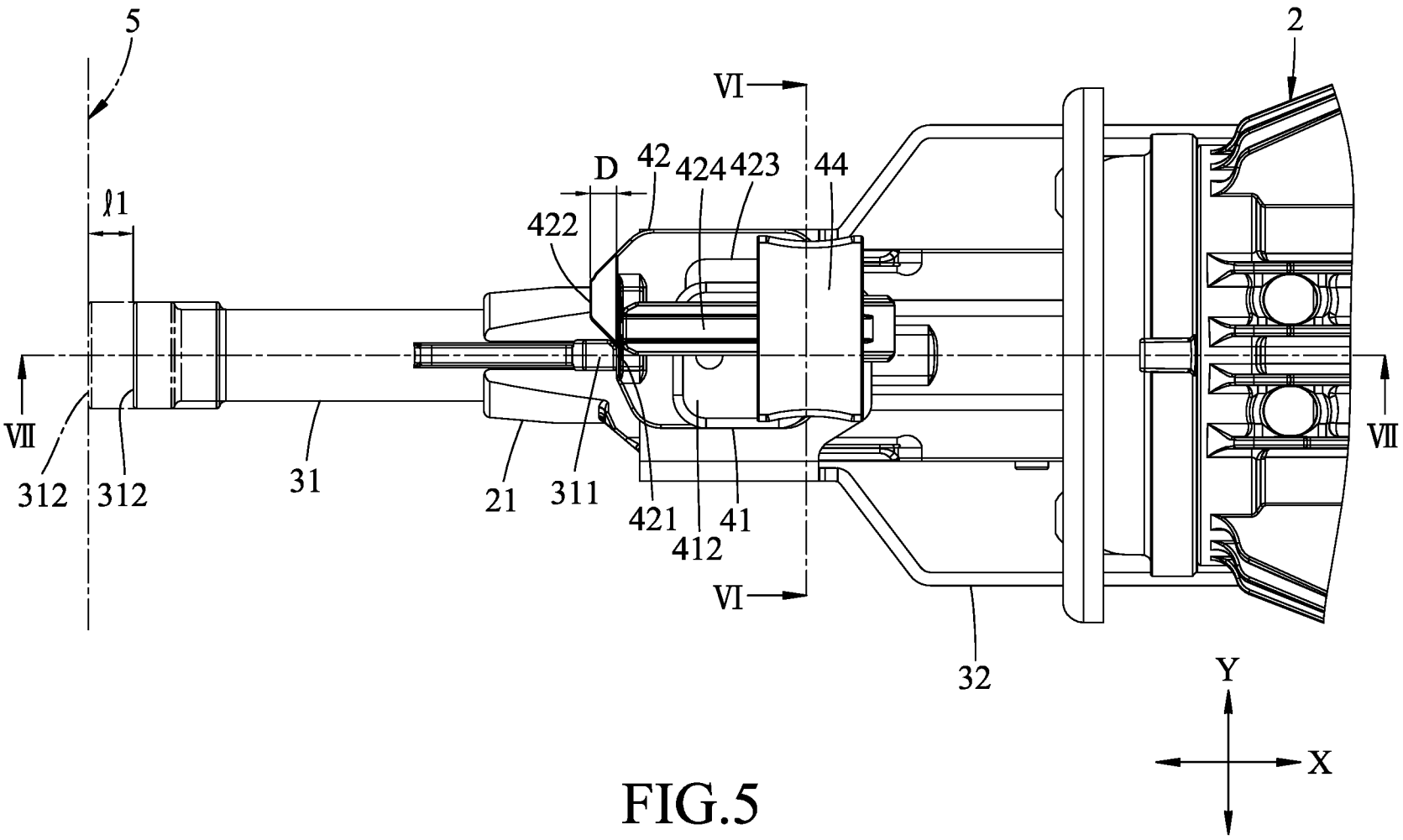
FIG. 5 is a fragmentary top view illustrating a switch member of the embodiment at a deep-drive position.
Figure 6:
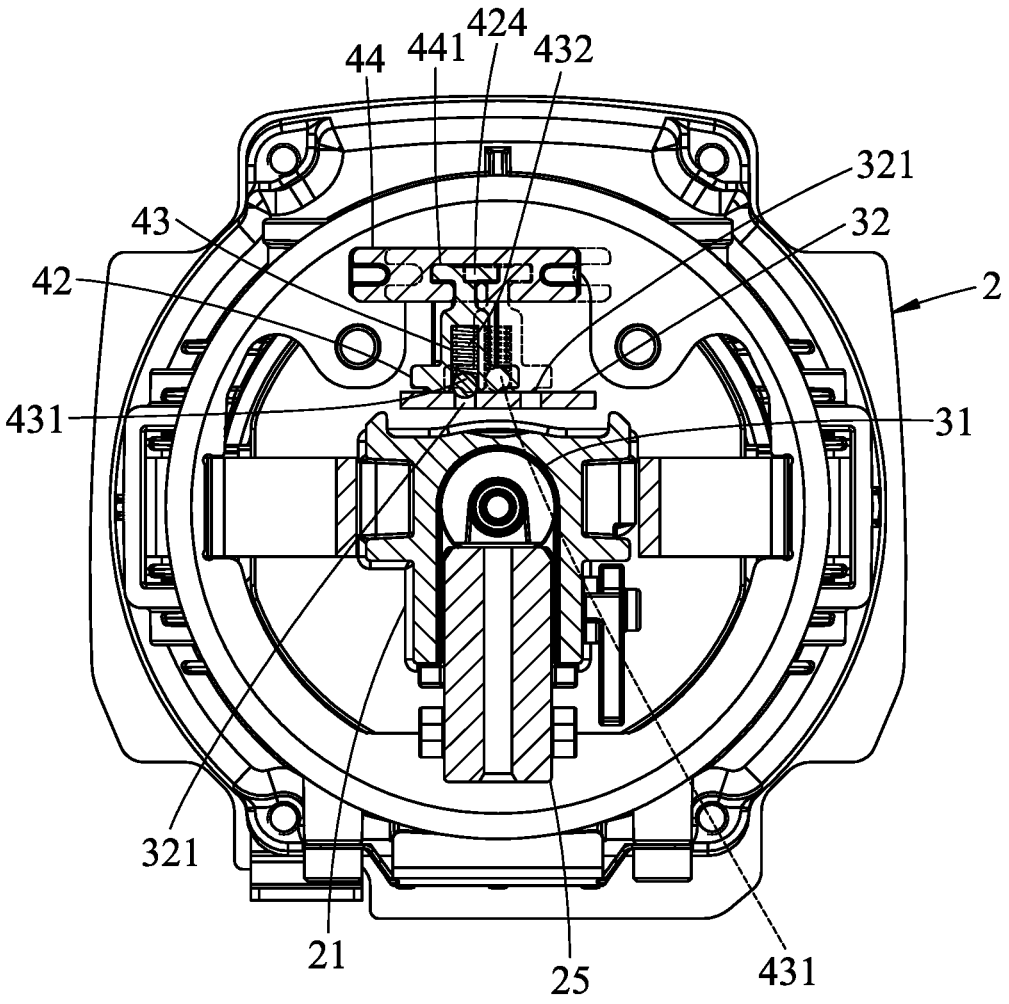
FIG. 6 is a sectional view taken along line VI-VI in FIG. 5.

Referring to FIGS. 5 to 7, when the operating member 44 is moved to a position as shown in FIG. 5, the switch member 42 is moved to the deep-drive position by the operating member 44. At this time, the latch member 431 of the positioning assembly 43 engages one of the positioning structures 321 of the second safety member 32 so as to position the switch member 42 relative to the second safety member 32.

Referring to FIG. 5, when the pressing end 312 of the first safety member 31 is pressed against an object 5, the first safety member 31 first moves toward the second safety member 32 in the lengthwise direction (X) by a first distance (11) before the abutment portion 311 of the first safety member 31 is in contact with the first abutment surface 421 of the switch member 42. Referring further to FIGS. 7 and 8, the first safety member 31 then pushes the switch member 42 to move the second safety member 32 from the initial position to the actuating position so as to activate the operation portion 24.

In the case that the travel distance of the second safety member 32 from the initial position to the actuating position is 4 millimeters, a total travel distance (L) of the first safety member 31 for activating the operation portion 24 is the first distance (11) plus 4 millimeters.

Figure 9:
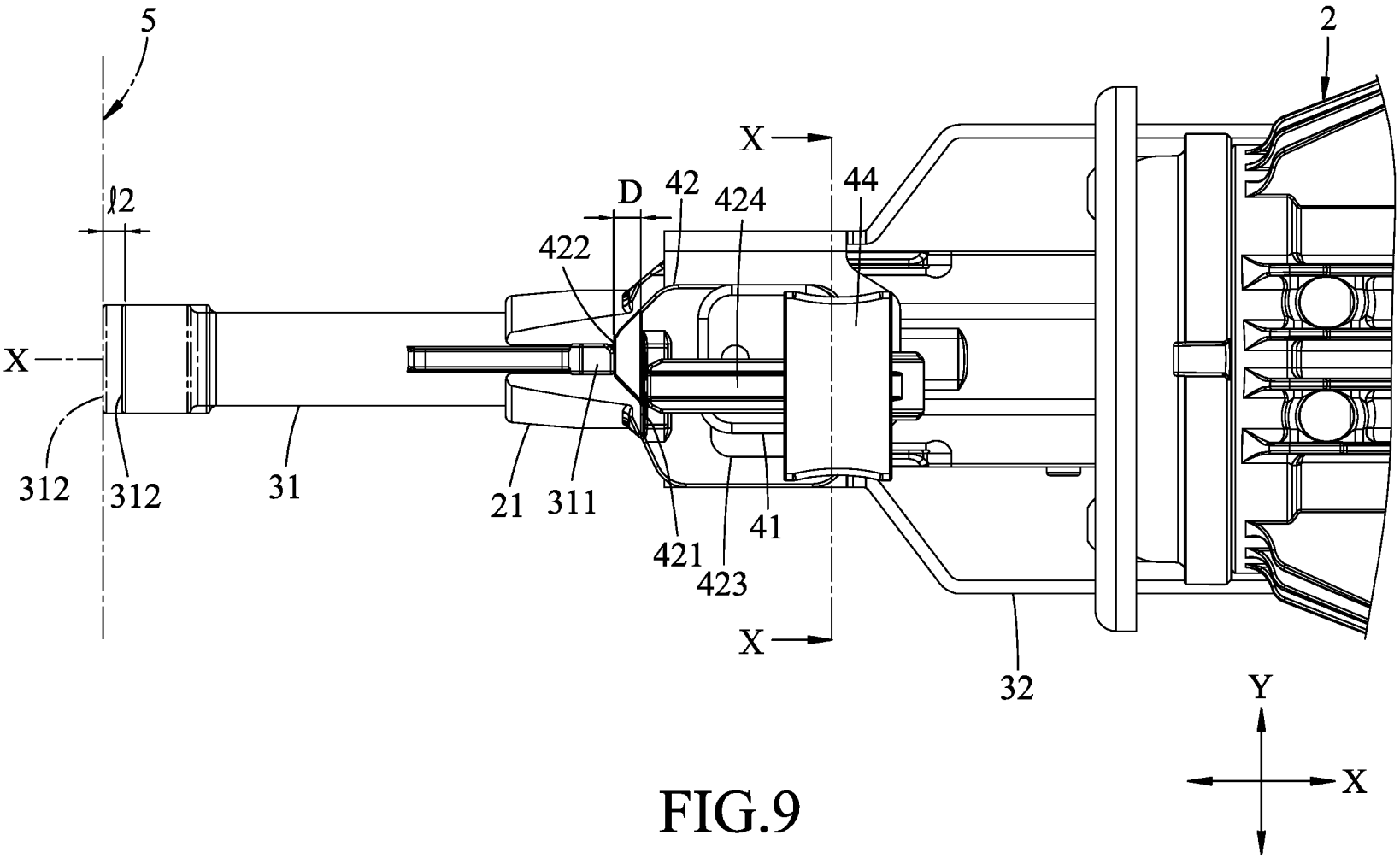
FIG. 9 is a fragmentary top view illustrating the switch member at a shallow-drive position.
Figure 10:
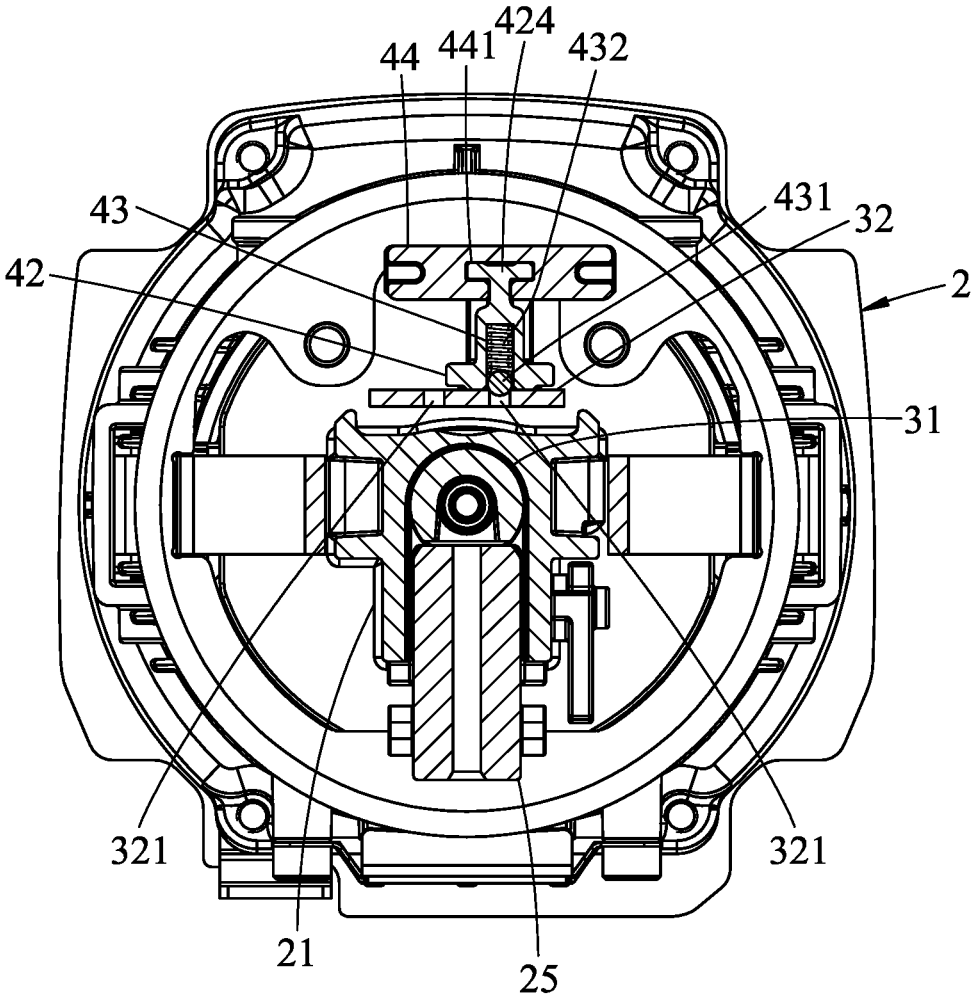
FIG. 10 is a sectional view taken along line X-X in FIG. 9.
Figure 11:
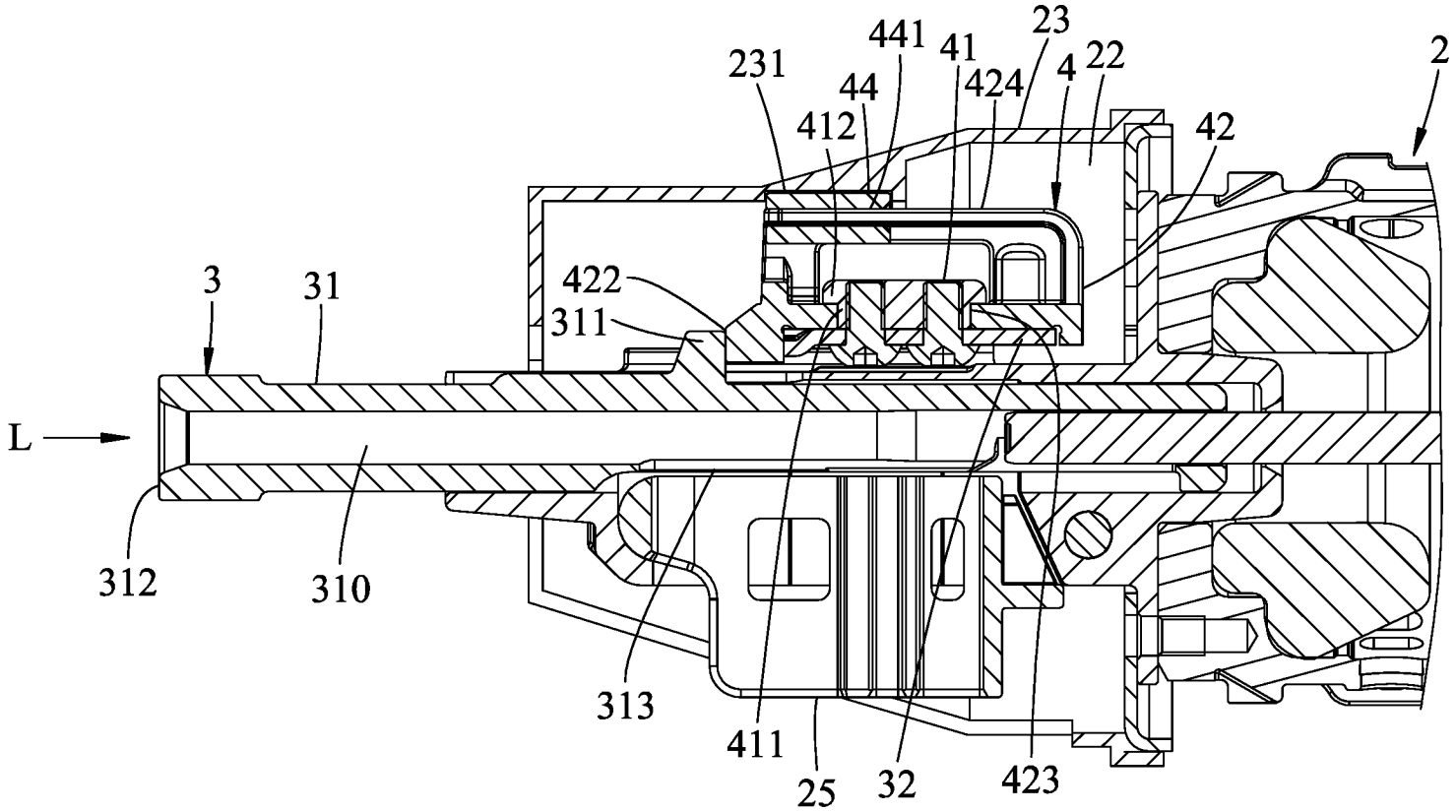
FIG. 11 is a sectional view similar to FIG. 8 and illustrating the second safety member at the actuating position.

Referring to FIGS. 9 to 11, when the operating member 44 is moved to a position as shown in FIG. 9, the switch member 42 is moved to the shallow-drive position by the operating member 44. At this time, the latch member 431 of the positioning assembly 43 engages the other one of the positioning structures 321 of the second safety member 32 so as to position the switch member 42 relative to the second safety member 32.

By such, when the pressing end 312 of the first safety member 31 is pressed against the object 5, the first safety member 31 first moves toward the second safety member 32 in the lengthwise direction (X) by a second distance (12) before the abutment portion 311 of the first safety member 31 is in contact with the second abutment surface 422 of the switch member 42. Then, the first safety member 31 pushes the switch member 42 to move the second safety member 32 from the initial position to the actuating position so as to activate the operation portion 24.

Since the second abutment surface 422 is located ahead of the first abutment surface 421 by the length difference (D), the second distance (12) is smaller than the first distance (11) by the length difference (D). By virtue of the switch of the switch member 42 between the deep-drive position and the shallow-drive position, the extent by which the first safety member 31 projects out of the muzzle 21 can be adjusted, so as to adjust the depth-of-drive of the nails fired by the nail gun.

It should be noted that, the adjusting unit may be configured such that, the abutment portion 311 of the first safety member 31 is in contact with the second abutment surface 422 of the switch member 42 when the switch member 42 is at the shallow-drive position and when the pressing end 312 of the first safety member 31 is not pressed against the object 5.

In summary, to adjust the depth-of-drive of the nails fired by the nail gun according to the disclosure, a user only needs to move the operating member 44 in the lateral direction (Y). Such operation would not be hindered by other components, and is relatively convenient compared with the prior arts.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A nail gun comprising:

a gun body including a muzzle, and an operation portion for activating firing operation;

a safety unit including a first safety member that is movable relative to said muzzle in a lengthwise direction of said gun body, and a second safety member that is able to be pushed by said first safety member to actuate said operation portion and that is movable relative to said gun body between an initial position and an actuating position, said first safety member has an abutment portion, said second safety member being distal from a rear portion of said gun body when said second safety member is at the initial position, said second safety member being proximate to said rear portion of said gun body and actuating said operating portion when said second safety member is at the actuating position; and an adjusting unit including a fixing member that is comovably mounted to said second safety member, and a switch member that is disposed between said fixing member and said second safety member and that is movable relative to said second safety member in a lateral direction of said gun body between a deep-drive position and a shallow-drive position, said switch member being pushed by said first safety member so as to move said second safety member, and having a first abutment surface, and a second abutment surface that is misaligned from said first abutment surface in the lengthwise direction and that is located ahead of said first abutment surface by a distance, said first abutment surface being aligned with said abutment portion of said first safety member when said switch member is at the deep-drive position, said second abutment surface being aligned with said abutment portion of said first safety member when said switch member is at the shallow-drive position;

wherein, when a pressing end of said first safety member is pressed against an object, said first safety member first moves toward said second safety member in the lengthwise direction by a distance before said abutment portion of said first safety member is in contact with said first abutment surface or said second abutment surface of said switch member.

2. The nail gun as claimed in claim 1, wherein said second safety member has two positioning structures that are disposed in the lateral direction, said adjusting unit further including a positioning assembly that is mounted to said switch member, said positioning assembly being removably coupled to one of said positioning structures when said switch member is at the deep-drive position, said positioning assembly being removably coupled to the other one of said positioning structures when said switch member is at the shallow-drive position.

3. The nail gun as claimed in claim 2, wherein said positioning assembly includes a latch member that is movable relative to said switch member and that is removably coupled either one of said positioning structures of said second safety member.

4. The nail gun as claimed in claim 3, wherein each of said positioning structures is configured as a recess, said latch member being configured as a spherical body, said positioning assembly further including a resilient member that resiliently biases said latch member to removably engage a selective one of said positioning structures.

5. The nail gun as claimed in claim 2, wherein said positioning assembly includes an operating member that slidably engages said switch member, said switch member being capable of being pushed by said first safety member to move in the lengthwise direction relative to said muzzle and said operating member.

6. The nail gun as claimed in claim 5, wherein said operating member is formed with a guide groove that extends in the lengthwise direction, said switch member further having a guide rail that slidably engages said guide groove of said operating member.

7. The nail gun as claimed in claim 5, wherein said gun body further includes a cap member that is mounted on said muzzle, said cap member being formed with a mounting groove that extends in the lateral direction, said operating member being movably mounted to said mounting groove of said cap member.

8. The nail gun as claimed in claim 1, wherein said fixing member has a guide portion that is fixedly connected to said second safety member, and a limiting portion that is fixedly connected to said guide portion, said switch member further having a guide opening permitting said guide portion of said fixing member to extend therethrough, said switch member being in slidable contact with said second safety member, said limiting portion of said fixing member being in slidable contact with said switch member so as to confine said switch member.

9. The nail gun as claimed in claim 1, wherein said second safety member is co-movable with said operation portion.

* * * * *